US006078302A

United States Patent [19]

Suzuki

[11] Patent Number: 6,078,302

[45] Date of Patent: Jun. 20, 2000

[54] SCREEN BRIGHTNESS CONTROL

[75] Inventor: Takaharu Suzuki, Kanagawa, Japan

[73] Assignee: NEC Corporation, Tokyo, Japan

[21] Appl. No.: 09/023,986

[22] Filed: Feb. 13, 1998

[30] Foreign Application Priority Data

Feb. 14, 1997 [JP] Japan ..... 9-030434

[51] Int. Cl.[7] ..... G09G 3/30

[52] U.S. Cl. ..... 345/77; 345/102; 345/207; 345/211; 345/212

[58] Field of Search ..... 345/102, 207, 345/77, 211, 212

[56] References Cited

U.S. PATENT DOCUMENTS

| | | | |
|---|---|---|---|
| 4,487,481 | 12/1984 | Suzawa | 349/67 |
| 4,760,389 | 7/1988 | Aoki et al. | 345/102 |
| 5,093,654 | 3/1992 | Swift et al. | 345/76 |
| 5,225,822 | 7/1993 | Shiraishi et al. | 340/784 |
| 5,315,695 | 5/1994 | Saito et al. | 345/432 |
| 5,337,073 | 8/1994 | Tsunoda et al. | 345/207 |
| 5,363,223 | 11/1994 | Beesley | 349/72 |
| 5,406,305 | 4/1995 | Shimomura et al. | 345/102 |
| 5,747,938 | 5/1998 | Beard | 315/169.3 |
| 5,760,760 | 6/1998 | Helms | 345/102 |
| 5,786,801 | 7/1998 | Ichise | 345/207 |
| 5,854,662 | 12/1998 | Yuyama et al. | 348/790 |

FOREIGN PATENT DOCUMENTS

| | | |
|---|---|---|
| 5-265401 | 10/1993 | Japan . |
| 2225894 | 6/1990 | United Kingdom . |
| 2285329 | 7/1995 | United Kingdom . |
| 2308459 | 6/1997 | United Kingdom . |

*Primary Examiner*—Richard A. Hjerpe
*Assistant Examiner*—Henry N. Tran
*Attorney, Agent, or Firm*—Scully, Scott, Murphy & Presser

[57] ABSTRACT

A screen-illuminating panel for a backlit LCD is intermittently adjusted to an optimal brightness level varying depending on ambient illumination at predetermined time intervals. The screen-illuminating panel is driven to hold the optimal brightness level while the screen-illuminating panel is not adjusted, a timer is used to detect a lapse of a time period to produce a timing signal after a trigger signal is received, and a power controller supplies power for brightness adjustment when the timing signal is received from the timer and outputs the trigger signal to the timer when the screen-illuminating panel has been adjusted.

9 Claims, 3 Drawing Sheets

SCREEN BRIGHTNESS CONTROL

BACKGROUND OF THE INVENTION

1. Field of the Invention

The present invention generally relates to screen brightness control, and in particular to a control method for a screen-illuminating panel.

2. Description of the Related Art

Backlit LCD displays have been widely used in handy or laptop computers and small, battery-powered electronic devices. To further improve the LCD screen's readability, there have been proposed backlit LCD displays which are capable of automatically adjusting their brightness depending on ambient illumination.

In Japanese Patent Unexamined Publication No. 5-265401, a backlit LCD system is provided with a photo sensor and a brightness controller. The brightness controller calculates the optimal level of brightness based on illumination data received from the photo sensor, and then controls the drive current supplied to the backlighting panel so that the calculated optimal brightness is obtained on the LCD screen.

A backlit LCD display improves the LCD screen's readability but draws more power than an ordinary LCD display does. Therefore, it is desirable to be able to reduce power consumption, especially in the case of a battery-powered device such as a mobile telephone terminal.

SUMMARY OF THE INVENTION

An object of the present invention is to provide a screen-illumination control method and system which can achieve reduced power consumption.

According to the present invention, the screen-illuminating panel is intermittently adjusted to an optimal brightness level varying depending on ambient illumination at predetermined time intervals. The screen-illuminating panel is driven to hold the optimal brightness level while the screen-illuminating panel is not adjusted. The control system may be provided with a timer for detecting a lapse of a time period to produce a timing signal after a trigger signal is received, and a power controller for supplying power to the adjuster when the timing signal is received from the timer and outputs the trigger signal to the timer when the adjuster has adjusted the screen-illuminating panel.

DETAILED DESCRIPTION OF THE PREFERRED EMBODIMENT

Figure 1:
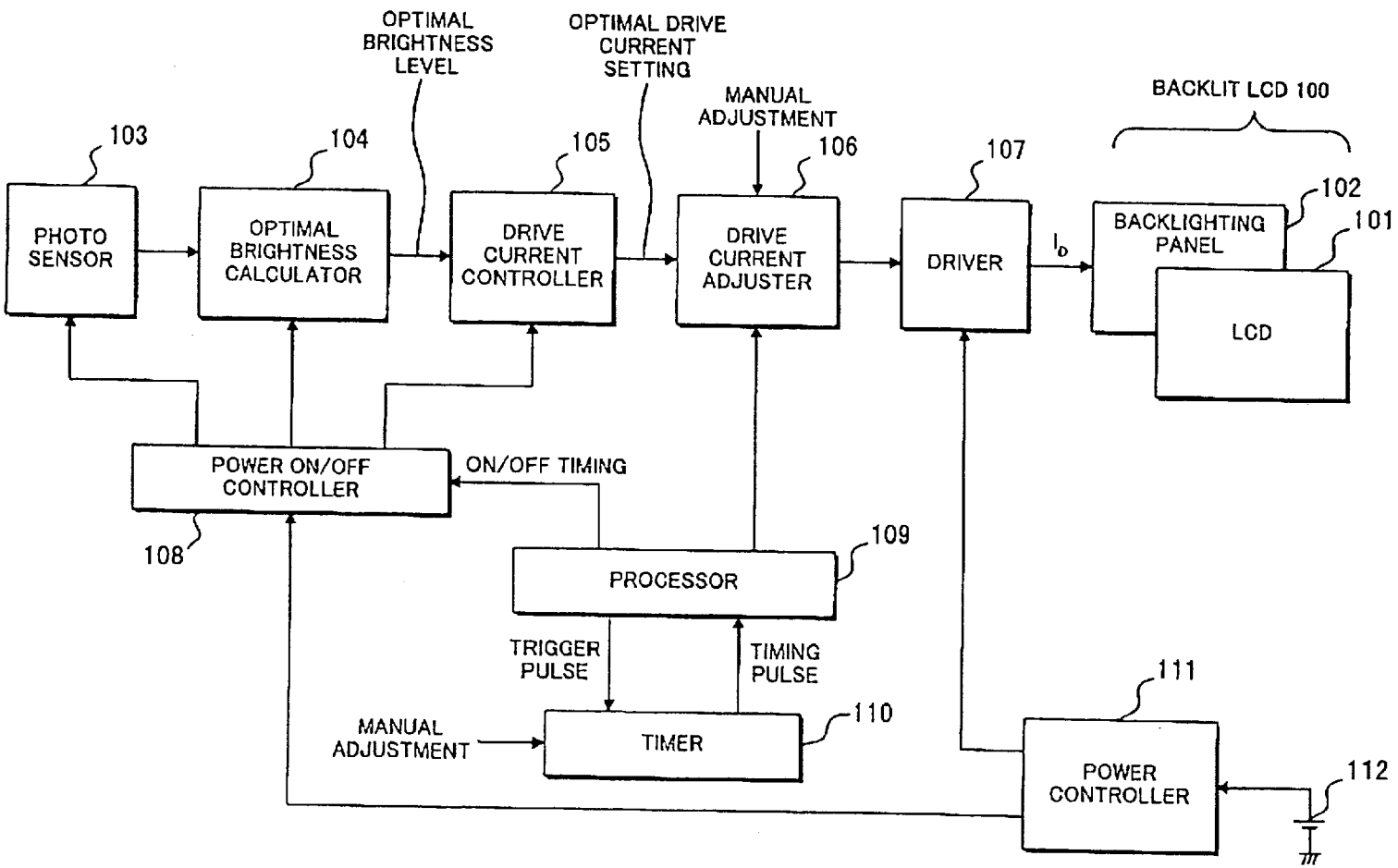
FIG. 1 is a block diagram showing a backlit-LCD control system according to an embodiment of the present invention.

Ref erring to FIG. 1, a backlit LCD display 100 is comprised of an LCD display 101 and a backlighting panel 102 which illuminates the back of the LCD screen. The backlighting panel 102 may be an electroluminescent panel placed behind the LCD screen.

The backlighting control system is provided with a photo sensor 103 which detects the ambient illumination of the LCD screen at controlled time intervals. The photo sensor 103 outputs ambient illumination data to an optimal brightness calculator 104 which calculates an optimal level of brightness at which a user can read information on backlit screen without causing eyestrain. The calculation is performed according to a predetermined expression at the controlled time intervals. When receiving the optimal brightness level data from the optimal brightness calculator 104, a drive current controller 105 produces optimal drive current setting data which causes the backlighting panel 102 to be set to the optimal brightness level at the controlled time intervals.

A drive current adjuster 106 receives and holds the optimal drive current setting data. The drive current adjuster 106 sets a driver 107 so that the optimal drive current $I_D$ is supplied to the backlighting panel 102. For example, the drive current adjuster 106 performs the pulse width control of the drive current $I_D$ depending on the optimal drive current setting data. In this embodiment, the drive current adjuster 106 can be manually adjusted by a user twisting a potentiometer for brightness control (not shown).

The photo sensor 103, the optimal brightness calculator 104 and the drive current controller 105 are supplied with power at the controlled time intervals. Such an intermittent power control is performed by a power on-off controller 108 under the control of a processor 109. The time interval of the intermittent power control is adjusted by a timer 110 which can be set to a manually adjustable time period. More specifically, the timer 110 is reset for the adjusted time period and starts counting when receiving a trigger pulse from the processor 109. When counting the time period, the timer 110 outputs a timing pulse back to the processor 109. According to the timing pulse, the processor 109 controls the power on/off controller 108 to supply power to the photo sensor 103, the optimal brightness calculator 104 and the drive current controller 105 for illumination detection and optimal brightness control.

A power controller 111 connected to a battery 112 supplies power to the driver 107 and the power on/off controller 108. The driver 107 supplies the drive current $I_D$ to the backlighting panel 102 depending on the optimal drive current setting data produced by the drive current controller 105. The processor 109 controls the driver current adjuster 106 according to the on/off timing. More specifically, when the photo sensor 103, the optimal brightness calculator 104 and drive current controller 105 are powered on, the drive current $I_D$ is varied depending on the calculated optimal brightness level. On the other hand, during a power-off period, the drive current $I_D$ is kept at a current corresponding to the latest optimal brightness level.

The optimal brightness calculator 104 calculates the optimal brightness level L using the following expression: $L=L_1+(R-R_1)\times(L_{2-L1})/LOG(R_2-R_1)$, where $L_1$ is a reference brightness level at lowest performance of the photo sensor, $L_2$ is a reference brightness level at highest performance of the photo sensor, R is an illumination level detected by the photo sensor, $R_1$ is a minimum illumination level detected by the photo sensor, and $R_2$ is a maximum illumination level detected by the photo sensor.

Figure 2:
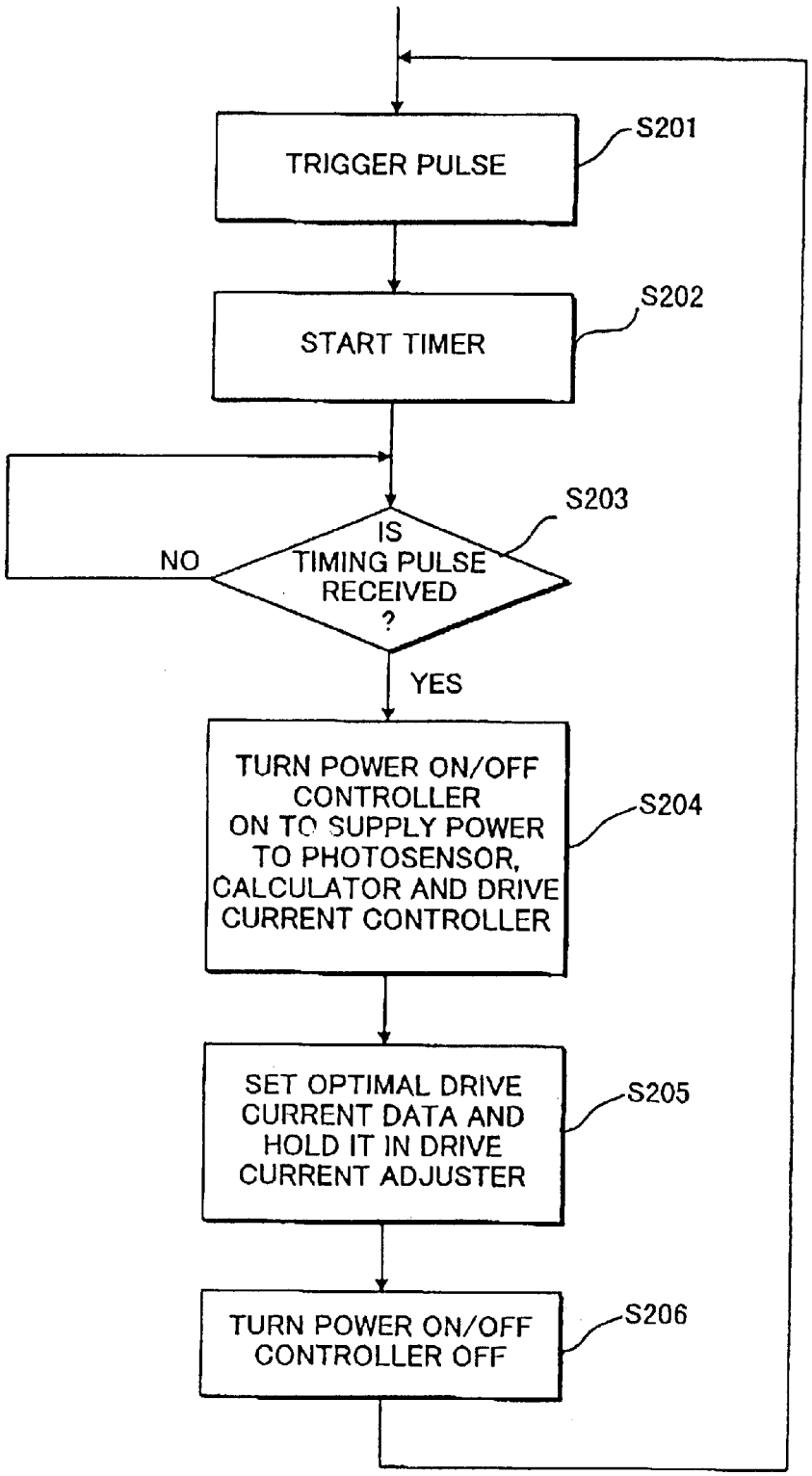
FIG. 2 is a flowchart showing a backlighting control operation of the embodiment.

Referring to FIG. 2, when the power is turned on, the processor 109 outputs a trigger pulse to the timer 110 (step S201). The trigger pulse causes the timer 110 to be reset for an adjustable time period and start counting (step S202).

The processor 109 checks whether the timing pulse is received from the timer 110 (step S203). When receiving the timing pulse (YES in step S203). the processor 109 turns on the power ON/OFF controller 108 so that power is supplied to the photo sensor 103, the optimal brightness calculator 104 and the drive current controller 105 (step S204). This causes ambient illumination measurement and optimal brightness calculation. After the optimal drive current setting data has been set and held in the drive current adjuster 106 (step S205), the power ON/OFF controller 108 is turned off so that power is not supplied to the photo sensor 103, the optimal brightness calculator 104 and the drive current controller 105 (step S206). Subsequently, control goes back to the step S201 where the processor 109 outputs the trigger pulse to the timer 110.

In this manner, ambient illumination measurement and optimal brightness control are intermittently performed at the time intervals determined by the timer 110. An example of operation will be described hereinafter in detail.

Figure 3:
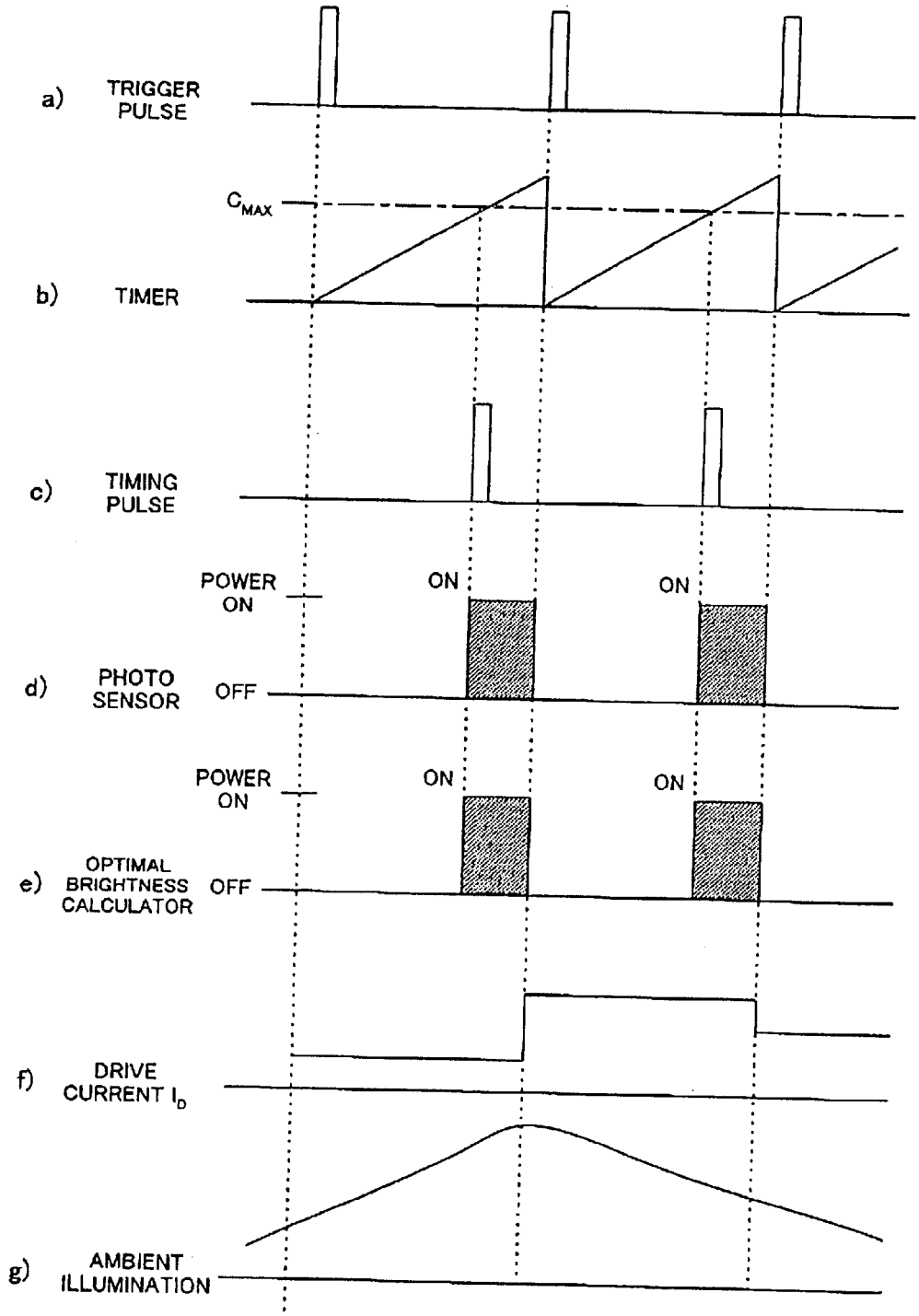
FIG. 3 is a time chart for explanation of the backlighting control operation of FIG. 2

As shown in FIG. 3, it is assumed that the timer 110 is reset for $C_{MAX}$ and the ambient illumination becomes higher with time (see b) and g) of FIG. 3).

When the processor 109 outputs a trigger pulse to the timer 110, the timer 110 is reset for the maximum count $C_{MAX}$ and starts counting (see f) of FIG. 3). When the timer 110 exceeds the maximum count $C_{MAX}$, the timer 110 outputs the timing pulse (see c) of FIG. 3). When receiving the timing pulse, the processor 109 turns on the power ON/OFF controller 108 so that power is supplied to the photo sensor 103, the optimal brightness calculator 104 and the drive current controller 105 (see d) and e) of FIG. 3). The optimal brightness calculator 104 calculates an optimal brightness level depending on the ambient illumination detected by the photo sensor 103. When the optimal drive current setting data has been set and held in the drive current adjuster 106, the driver 107 supplies the optimal drive current ID to the backlighting panel 102. At the same time, the power ON/OFF controller 108 is turned off so that power is not supplied to the photo sensor 103, the optimal brightness calculator 104 and the drive current controller 105 (see d) and e) of FIG. 3).

In this manner, ambient illumination measurement and optimal brightness control are intermittently performed at the time intervals determined by the timer 110. With varying in ambient illumination, the brightness of the backlighting panel 102 becomes higher or lower so as to improve the screen's legibility.

What is claimed is:

1. A control system for a screen-illuminating panel which is variable in brightness, comprising:

a) an adjuster for adjusting the screen-illuminating panel to an optimal brightness level varying depending on ambient illumination;

b) a driving controller for driving the screen-illuminating panel to hold the optimal brightness set by the adjuster; and c) a controller for operating the adjuster at predetermined time intervals to intermittently adjust the screen-illuminating panel, wherein the controller comprises, a timer for detecting a lapse of a time period to produce a timing signal after a trigger signal is received, and a power controller for supplying power to the adjuster when the timing signal is received from the timer and outputs the trigger signal to the timer when the adjuster has adjusted the screen-illuminating panel.

2. The control system according to claim 1, wherein the adjuster comprises:

a detector for detecting the ambient illumination; and an optimal brightness adjuster for calculating the optimal brightness level from the ambient illumination detected by the detector to adjust the screen-illuminating panel to the optimal brightness level.

3. The control system according to claim 1, wherein the timer is capable of setting the time period to a desired value.

4. The control system according to claim 1, wherein the driving controller is capable of manually changing the optimal brightness level.

5. A mobile information processing device comprising:

a) a backlit screen display which is variable in brightness;

b) a photo detector for detecting ambient illumination of the backlit screen display;

c) an adjuster for adjusting the backlit screen display to an optimal brightness level varying depending on the ambient illumination detected by the photo detector;

d) a driving controller for driving the backlit screen display to hold the optimal brightness set by the adjuster; and e) a controller for operating the photo detector and the adjuster at predetermined time intervals to intermittently adjust the backlit screen display, wherein the controller comprises, a timer for detecting a lapse of a time period to produce a timing signal after a trigger signal is received, and a power controller for supplying power to the photo detector and the adjuster when the timing signal is received from the timer and outputs the trigger signal to the timer when the adjuster has adjusted the backlit screen display.

6. The mobile information processing device according to claim 5, wherein the adjuster calculates the optimal brightness level from the ambient illumination using a predetermined mathematical expression.

7. A control method for a screen-illuminating panel placed behind an LCD display, comprising the steps of:

a) adjusting the screen-illuminating panel to an optimal brightness level varying depending on ambient illumination;

b) driving the screen-illuminating panel to hold the optimal brightness; and c) performing the step a) at predetermined time intervals to intermittently adjust the screen-illuminating panel, comprising the steps of, detecting a lapse of a time period to produce a timing signal after a trigger is received, turning power on to perform the step a) when the timing signal is received from the timer, providing the trigger signal and turning power off not to perform the step a) when the screen-illuminating panel has been adjusted.

8. The control method according to claim 7, wherein the step a) comprises the steps of:

detecting the ambient illumination; and calculating the optimal brightness level from the ambient illumination to adjust the screen-illuminating panel to the optimal brightness level.

9. The control method according to claim 7, wherein the step c) comprises the steps of:

detecting a lapse of a time period to produce a timing signal after a trigger signal is received; and performing the step a) when the timing signal is received from the timer; and providing the trigger signal when the screen-illuminating panel has been adjusted.

* * * * *